US005791087A

United States Patent [19]

Strab

[11] Patent Number: 5,791,087

[45] Date of Patent: Aug. 11, 1998

[54] AUTOMATIC DOOR/WINDOW OPERATOR

[76] Inventor: Thomas J. Strab, P.O. Box 77, Yorklyn, Del. 19736

[21] Appl. No.: 657,419

[22] Filed: Jun. 3, 1996

Related U.S. Application Data

[60] Provisional application No. 60/006,780 Nov. 15, 1995.

[51] Int. Cl.[6] ..... E05F 11/00

[52] U.S. Cl. ..... 49/360

[58] Field of Search ..... 49/360, 324

[56] References Cited

U.S. PATENT DOCUMENTS

| | | | |
|---|---|---|---|
| 2,891,567 | 6/1959 | Pottmeyer | 49/360 |
| 3,755,967 | 9/1973 | Nourse | 49/360 |
| 4,170,845 | 10/1979 | Owen | 49/360 X |
| 4,296,570 | 10/1981 | Balbach et al. | 49/360 |
| 4,941,320 | 7/1990 | Kersten et al. | 49/360 X |
| 5,269,098 | 12/1993 | Redman | 49/360 |
| 5,410,842 | 5/1995 | Watson | 49/360 |

*Primary Examiner*—Peter R. Brown
*Assistant Examiner*—Stephen Vu
*Attorney, Agent, or Firm*—Jeffrey C. Lew

[57] ABSTRACT

A sliding member operating system is disclosed which includes a adjustable pressure regulator (18)fluid control valves (15), (40), (50), (30), (80), (20), and (70) and an operating cylinder (60) which is mounted to the sliding element of a door or window (66) and its adjacent frame (62) for the purpose of opening and closing and holding said sliding element. This system utilizes the fluid being exhausted from cylinder (60) during the closing cycle to hold open valve (30) insuring that a door or window in motion will continue to stay in motion but that the power being supplied to a moving door or window, once halted by any means, will cease. An additional series of valves is utilized to pressurize cylinder 60 for the purpose of holding a door or window in the closed position. The rate of fluid bleed at valve 50 is adjustable to control closing speed and the sensitivity at which the sliding element will stop if an object is encountered during the closing cycle or if the door/window closes completely.

18 Claims, 4 Drawing Sheets

AUTOMATIC DOOR/WINDOW OPERATOR

This application claims the benefit of U.S. Provisional Application Ser. No. 60/006,780 filed Nov. 15, 1995.

This invention relates to an operating system which utilizes a regulated fluid, a power cylinder and a series of valves for the purpose of opening, closing and locking sliding doors and windows in a safe and gentle manner.

BACKGROUND OF THE INVENTION

Prior fluid powered operating systems that have been developed for controlling the movement of sliding doors and windows utilize electrical interface methods to operate control valves. This method substantially adds to the cost and complexity of these devices rendering this technology of little value as a means of retrofitting doors and windows commonly found in the typical residence or business. These known devices include a variety of electrical switches and sensors for the purpose of controlling movement, sensing location and permitting these units to operate in a safe manner.

Electro-mechanical systems have also been developed for a similar purpose. These units utilize an electric motor and mechanical means [a cable or chain for example] to provide movement and necessarily complex electrical sensors for control. As with prior fluid powered systems, the complexity and associated cost render these devices of little value in the home or office.

It is therefore desired from the standpoint of cost, ease of assembly and operation, safety, number of parts, and reliability, an operating system that is suitable for retrofitting existing doors and windows, easy to install, easy to relocate, is inexpensive, reliable, compact, quiet, and inherently safe in operation.

SUMMARY OF THE INVENTION

It is the object of the present invention to provide a low cost door/window operating system.

It is a further object of this invention to provide an operating system which is gentle in its movement and otherwise safe to use.

It is yet another object of this invention to provide a door/window operating system which is easy to install, assemble and maintain.

It is still another object of the present invention to provide a door/window operating system suitable for retro-fitting existing doors and windows, that is easy to relocate, and can be utilized in an equal capacity with new construction of dwellings and places of business.

It is another object of this invention to provide a means of holding sliding doors and windows in the open or closed position.

It is a still further object of this invention to provide a door/window operating system which does not substantially interfere with the normal manual operation of said door or window.

Accordingly, the present invention achieves these objects with the use of a source of compressed fluid, a series of valves, a pressure regulator, and an operating cylinder functionally mounted to a sliding door or window and its adjacent frame. This system does not utilize electricity for any purpose other than the possible initial activation of the unit or the possible production of compressed fluid.

DETAILED DESCRIPTION OF THE INVENTION

Figure 1:
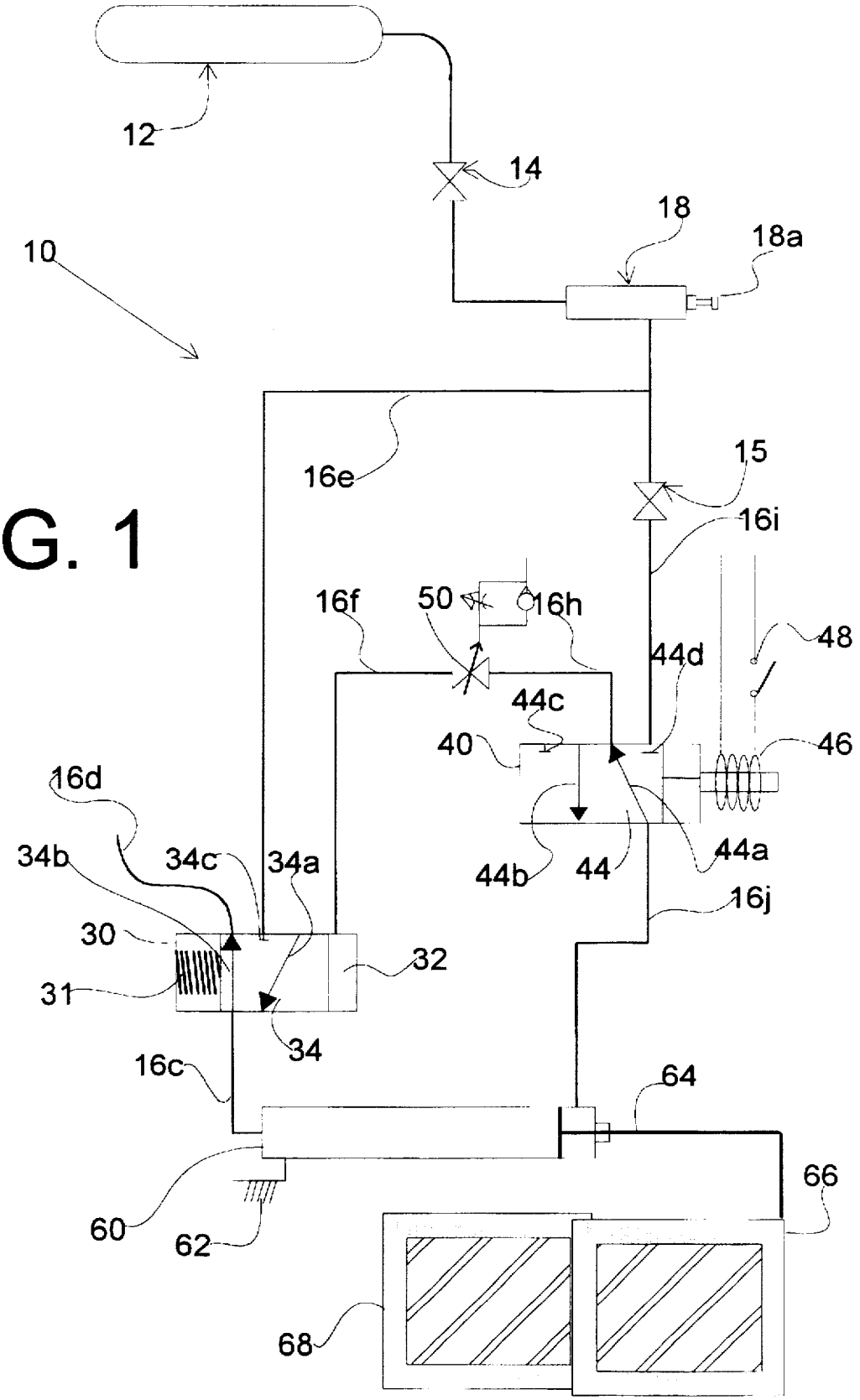
FIG. 1 shows a schematic view of the basic door operating system according to the present invention when the door is in the fully closed position and the system is deactivated.

Referring to the above described Figures, the basic door operating system 10 includes a pressurized fluid tank 12; a shut off valve for said tank 14; a pressure regulator 18 with an adjusting knob 18*a*; tubing 16 with tubing sections 16*a* through 16*j*; an adjustable throttle valve 15; a set of valves 30 and 40; and an additional adjustable valve venting to the atmosphere 50. Additionally, a fluid pressure operated cylinder 60 is securely mounted to a frame 62, and a rod 64 is securely mounted to a sliding door 66. A stationary door 68 is mounted adjacent to sliding door 66.

Valve 30 includes a biasing member, for example, a spring 31 which is connected to a spool 34. Spool 34 includes fluid channels 34*a*; 34*b* and a cap 34*c*. Additionally valve 30 contains an orifice 16*d* allowing fluid to pass from tubing section 16*c* to vent to the atmosphere. Valve 30 also contains a chamber 32, which when pressurized, acts against the biasing member shifting the spool 34. This device described as Valve 30 is commonly referred to as a pressure activated three way valve. Valve 30 is operatively connected to tubing sections 16*c*, 16*e*, and also to 16*f* which conveys fluid whose purpose is to activate this valve.

Valve 40 comprises a spool member 44 having channels 44*a*, 44*b* and caps 44*c* and 44*d*. Spool 44 is operatively connected to a solenoid 46 which is capable of displacing the spool 44 upon activation of electrical switch 48. Valve 40 is operatively connected to tubing sections 16*h*, 16*i*, and 16*j*. This device is commonly referred to as a three way solenoid valve.

OPERATION OF THE BASIC SYSTEM

Referring first to the conditions of FIG. 1, we can observe that fluid under pressure in tank 12 is capped at 44*d* in valve 40 and at 34*c* in valve 30. There is no flow of fluid in this state of deactivation. The door 66 is however free to move manually because both ports of cylinder 60 are open to the atmosphere. One through tubing 16*c*, fluid channel 34*b*, and vent 16*d*. The other through tubing 16*j*, fluid channel 44*a*, tubing 16*h*, and valve 50. It is therefore apparent that door 66 will operate in a normal manner by anyone not choosing to use the operating device.

Figure 2:
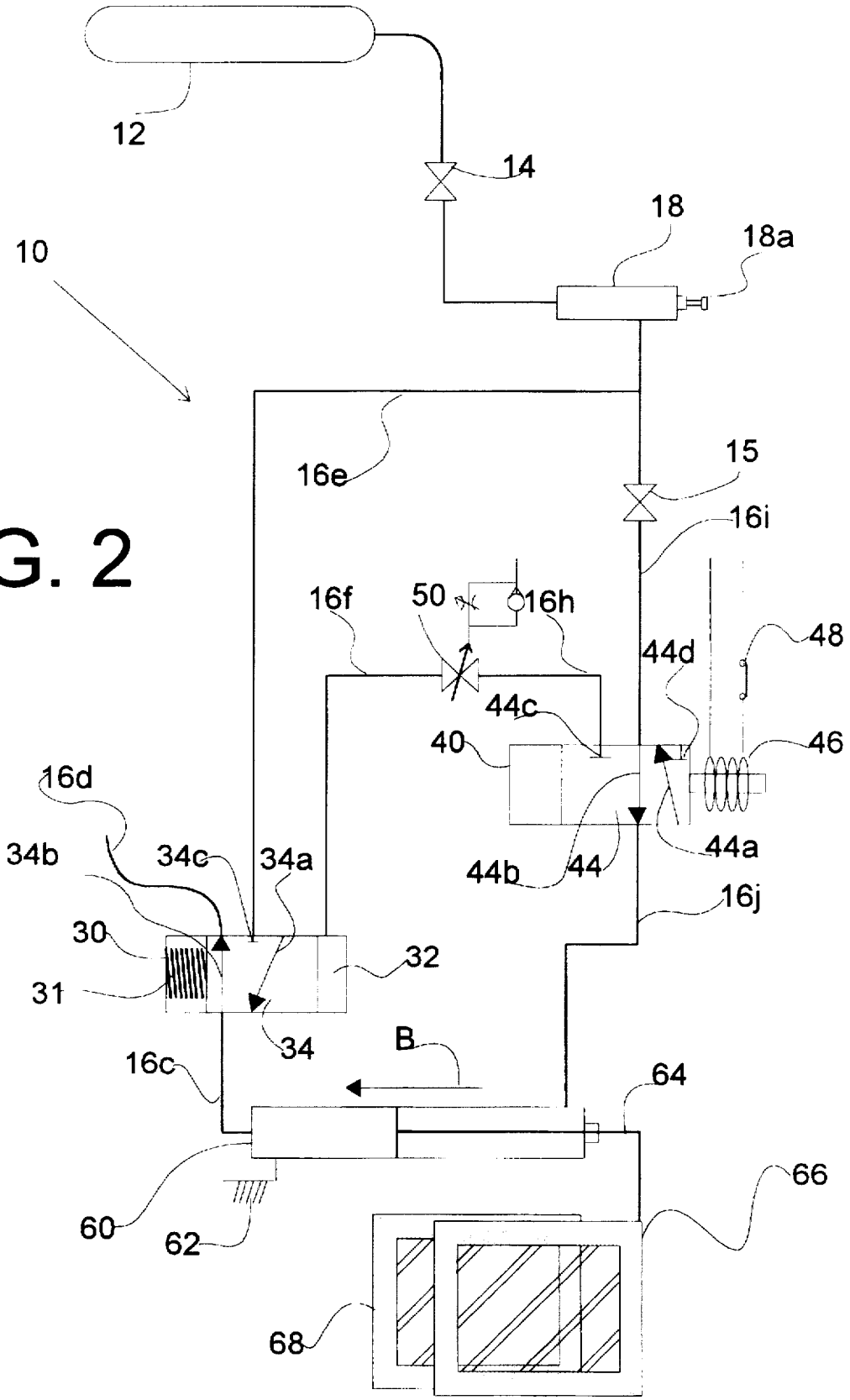
FIG. 2 shows a schematic view of the basic door operating system according to the present invention when the system is activated and the door is moving toward the open position.

Referring next to FIG. 2, where the operator has activated switch 48 causing spool 44 of valve 40 to shift so that channel 44*b* will be in fluid communication with tubing sections 16*i* and 16*j*, thereby permitting fluid to flow to cylinder 60. Cylinder 60 in this pressurized state will cause rod 64 to move in the direction of arrow B, and door 66 will thereby be moved to the open position. Valve 15 is adjustable to control the opening speed of door 66 and cooperates with regulator 18 for this purpose. As the piston in cylinder 60 moves, it forces the fluid on the other side of the piston into tubing section 16*c*, through channel 34*b* of valve 30, and finally to the atmosphere at vent 16*d*. Pressure will continue to act on the cylinder piston until the door 66 is fully open and remain in this state until such time as the operator chooses otherwise.

Figure 3:
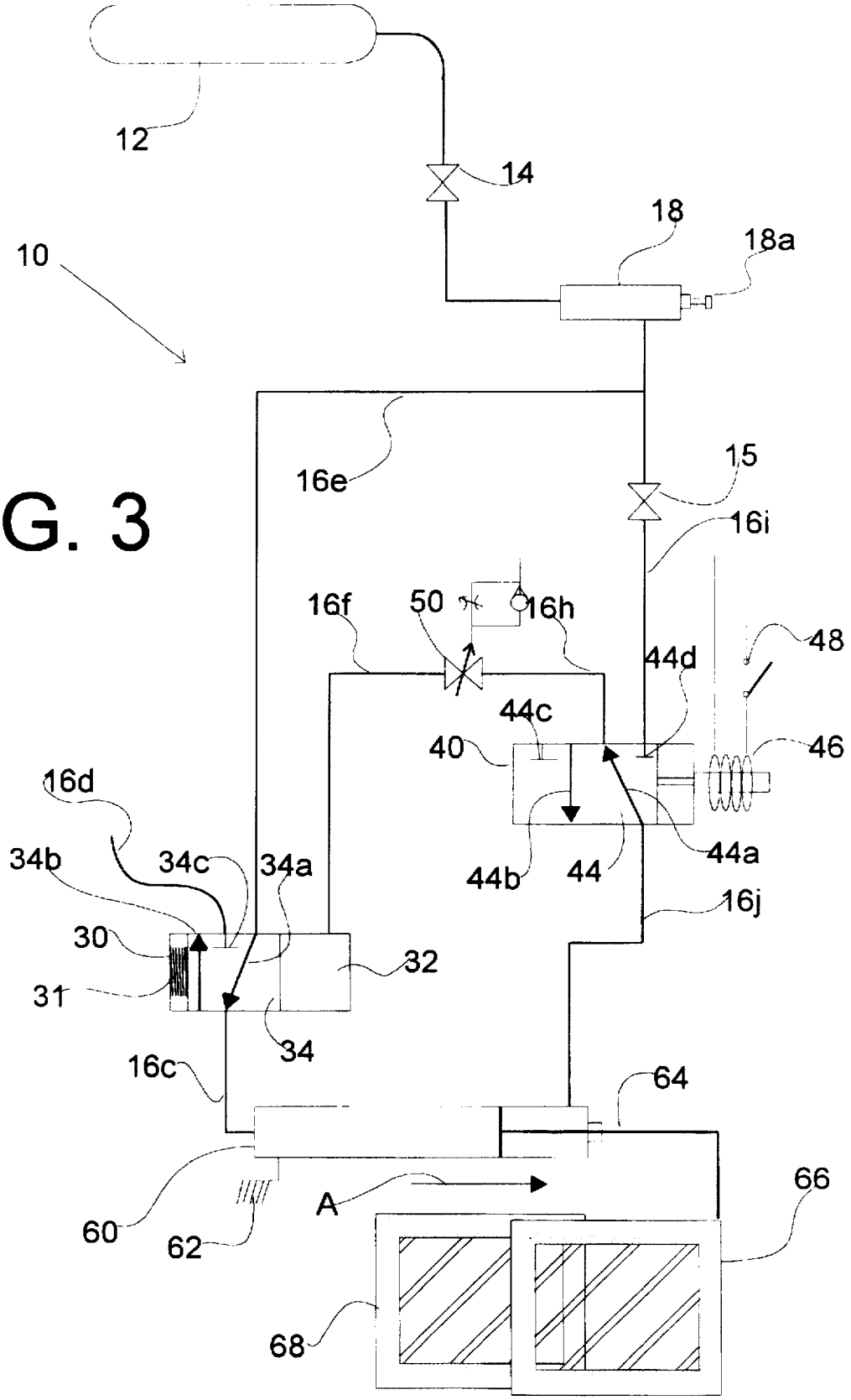
FIG. 3 shows a schematic view of the basic door operating system according to the present invention when the system is deactivated and the door is moving toward the closed position.

Referring next to FIG. 3, it is apparent that the operator has deactivated switch 48 which has caused spool 44 to shift to it's previous position of alignment with tubing sections 16*j* and 16*h*. The fluid which was captive under pressure in cylinder 60 now is free to flow through tubing 16*j*, to channel 44*a*, out of valve 40 to tubing 16*h*. It is then metered to the atmosphere through valve 50 at such a rate that tubing section 16*f* and chamber 32 of valve 30 will remain pressurized for a period of time sufficient to cause spool 34 to shift so that channel 34*a* is in alignment with tubing sections 16*e* and 16*c*. Tubing 16*e* contains pressurized fluid which is now free to pass through channel 34*a* and tubing 16*c* to cylinder 60 thereby forcing the piston of cylinder 60 to move in the direction of arrow A. The pressurized fluid will thus be supplied to cylinder 60 from valve 30 only as long as sufficient pressure exists in chamber 32 to maintain the spool 34 in its position of alignment with tubing sections 16*e* and 16*c*. It is important to note that as the piston in cylinder 60 is moving in the direction of arrow A, fluid will continue to be forced along its path to valve 50 and chamber 32 thereby maintaining spool 34 in its present position of alignment only as long as door 66 continues to move toward the closed position. When the piston of cylinder 60 stops, which is when the door is fully closed or is stopped by an object while it is closing, no more fluid is forced to wend its way to chamber 32, and therefore spool 34 will be biased back to its original position as shown in FIG. 1 and FIG. 2. At this point the door operating system 10 has come full circle back to its original conditions and is once again free to be easily moved manually.

It is also important to note that the rate of fluid passage at valve 50 is directly related to the sensitivity at which the door will be brought to a stop such that a preferred adjustment of valve 50 will cause the door 66 to come to a gentle stop when coming to the closed position or upon encountering an object. Moreover the slowing of the rate of fluid passage at valve 50 also has a direct effect on the speed the door will close and cooperates with regulator 18 in this respect.

Referring again to FIG. 1, the operating cycle during manual use of the door, will more closely be examined. A manual movement of the door forces fluid from the cylinder, into tubing section 16*c*, through valve 30 by way of passage 34*b* and finally to the atmosphere at vent 16*d*. This flow of fluid is not substantially restricted by any means. Correspondingly, this same movement draws fluid from tubing section 16*j*, through valve 40 by way of passage 44*a*, through tubing section 16*h* and valve 50. In the preferred embodiment of this invention valve 50 is of the type that meters flow to the atmosphere while permitting fluid to flow freely in the opposite direction. [Pneumadyne inc. model FC-52 or others] The flow diagram above valve 50 shows this flow pattern. Since there is essentially no restriction of the fluid passage in this direction there is essentially no impedance to the manual opening of the door. However, when a manual closing cycle is initiated, fluid flows backward through the path just described. In this case a partial restriction does occur which causes pressure to build up. This pressure build up causes the same reaction of valve 30 previously described and referred to in detail in FIG. 3. Therefore, manual operation of a door is unimpeded in the opening direction and power operated in the closing direction.

DETAILED DESCRIPTION OF THE LOCKING DEVICE

Figure 4:
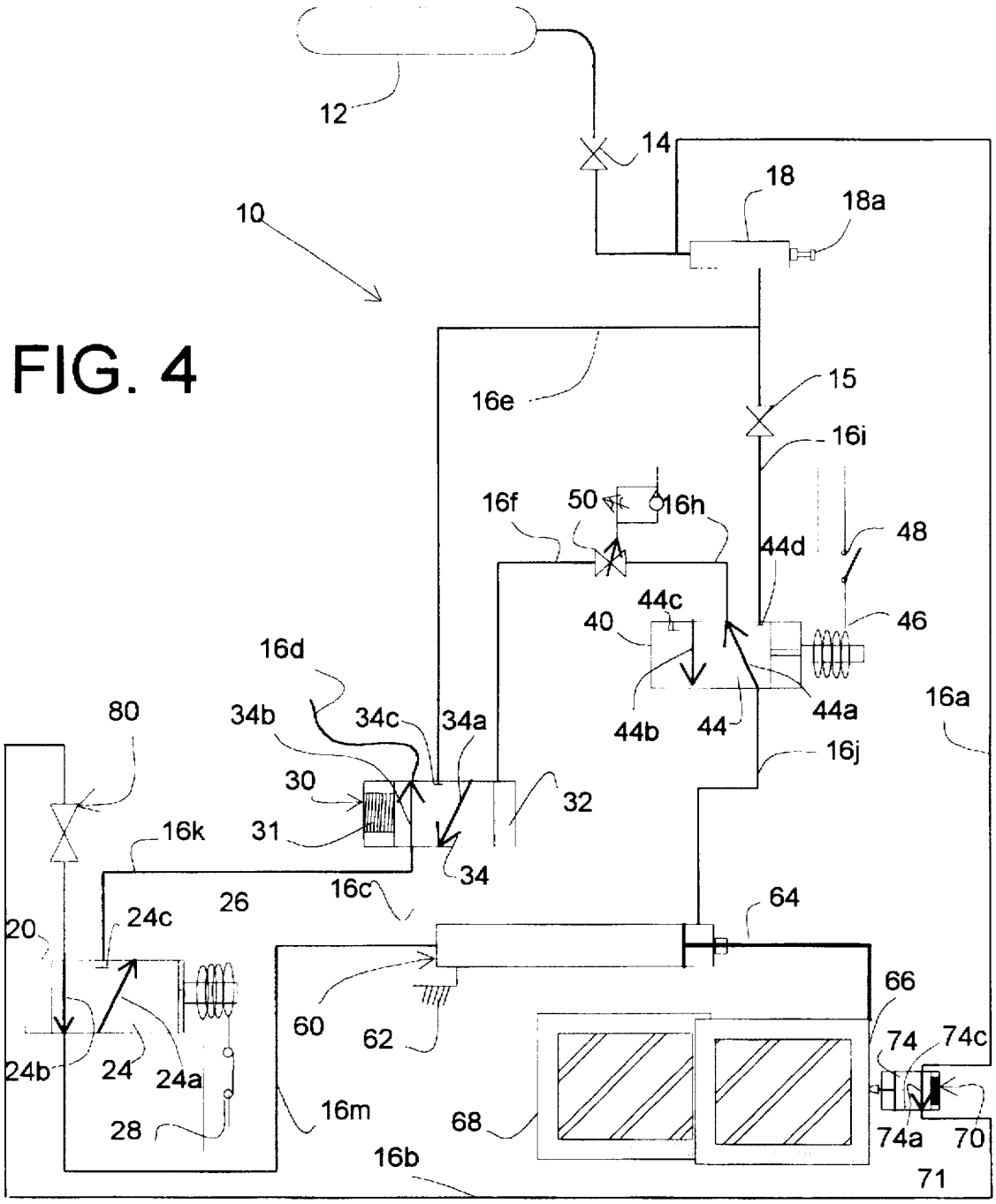
FIG. 4 shows a schematic view of the door operating system according to the present invention when the door is in the fully closed position with the cylinder locked with fluid pressure.

Referring now to FIG. 4 it is shown that the basic operating system 10 has been modified with the addition of valve 20, throttle valve 80, tubing sections 16*a*, 16*b*, 16*k* and 16*m*, and valve 70. Valve 20 operates in substantially the same manner as valve 40 previously described. Valve 70 includes a biasing member 71, spool 74 fluid passage 74*a* and cap 74*c*. Valve 80 is a simple throttle valve and is substantially the same as valve 15. Tubing section 16*c* shown in FIG. 1, FIG. 2 and FIG. 3 is conspicuously absent.

OPERATION OF THE LOCKING DEVICE

The conditions shown in FIG. 4 are that switch 28 has been activated, usually but not necessarily by remote control, which moves spool 24 so that fluid channel 24*b* is in fluid communication with tubing section 16*m* and 16*b*. Valve 70 is being acted upon by the edge of door 66 in such a manner as to shift spool 74 so that channel 74*a* is in fluid communication with tubing sections 16*b* and 16*a*. Since tubing section 16*a* is connected to the high pressure fluid supply of tank 12, fluid is free to flow directly into cylinder 60 thus holding the door in this locked position. It should be observed that valve 70 must be in the depressed mode to permit fluid to enter cylinder 60. This is a safety device so that the system cannot be activated unless door 66 is in the fully closed position therefore eliminating the possibility that this locking system can be used to close door 66 in an unsafe manner. Valve 80 is an additional back-up safety device so that if fluid is permitted to pass through valve 70 it will be restricted in its path to cylinder 60 thereby making the locking of door 66 occur slowly and if, for any reason, door 66 should be made to close under the higher pressure supplied through valve 70, this closing movement will occur in a slow, safe manner. If door 66 is forcibly moved in the opening direction against the fluid pressure being supplied, the biasing member 71 of valve 70 will cause spool 74 to shift so that tubing section 16*b* will be capped. Further movement of door 66 will therefore cause the captive fluid in cylinder 60, already under relatively high pressure, to be further compressed therefore increasing dramatically the amount of force necessary to continue movement of door 66. It can be observed, although not shown by a separate drawing, that when switch 28 is deactivated, valve 20 will revert back to a condition where tubing sections 16*m* and 16*k* are in the direct communication. The operation of this three way valve is substantially the same as valve 40 which can be referenced in FIG. 1 and FIG. 2. In this state of deactivation, fluid is free to pass to or from valve 30 by way of tubing section 16*k*, fluid channel 24*a* and tubing section 16*m*, to or from cylinder 60 thereby duplicating the original conditions supplied by tubing section 16*c*. This enables the basic operating system 10 to once again function normally.

PRACTICAL APPLICATION OF THE INVENTION

The practical application of this invention on sliding doors has, up to this point, been the focused use of this invention. It is to be understood by persons of ordinary skill in the art that the invention is not strictly limited to such embodiments, but may be otherwise variously embodied and practiced within the scope of the following discussion.

Generally speaking, the construction methods and materials used in the installation of windows, various gates and other sliding members is the same as that of doors. These methods consist of the construction of a framed opening of the proper size, the subsequent attachment of pre-hung units, and final trimming with moldings commonly known as casement moldings. Therefore, because the motions involved are substantially the same, this invention has direct application in the automatic operation of sliding windows and, with the cylinder mounted vertically, with double hung windows. The usefulness of the locking mechanism described in detail in FIG. 4 also functions substantially the same and has the same practical application on sliding windows and double hung windows as it does on sliding doors.

The mounting hardware used in the practical application of this invention is of the type commonly available and in general use with pneumatic cylinders. No claim is being made as to the uniqueness of their use with this invention.

In the full embodiment of this invention, electrical switches 48 and 28 of FIG. 4 would most commonly be controlled by a hand held transmitter and a receiver for the purpose of remote activation. A degree of security is therefore provided as these known devices have many possible codes. It is however known to a person skilled in this art that any method used to make an electrical contact would be adaptable for use with this device. A further adaptation is the substitution of compressed fluid pilot valves in lieu of the previously mentioned electric valves. These three way valves of the same configuration as valve 32 and will respond to a signal of compressed fluid rather than an electrical impulse yielding an increase in the versatility of control systems. An obvious use of this type of control would be to equip a door for public access without the use of retrofitting electric wires. It is interesting to note that compressed fluid is commonly available for sale in specially designed cylinders, such as Carbon dioxide, Nitrogen, Oxygen for example]. These cylinders, equipped with a suitable regulator, have the practical application of usage with this invention to render the system completely free of the use of electricity.

It is the applicant's opinion that the most practical embodiment of this invention is to give people with a physical disability a greater degree of control of their environment.

Accordingly, what is claimed is:

1. A sliding gate operating apparatus comprising:

a structure defining a framed opening for a gate;

a gate slidably mounted in the framed opening;

a fluid pressure activated cylinder having an axially disposed piston coupled to the gate so that the axial piston having a displacement which causes movement of the gate within the frame; the cylinder defining first and second cylinder chambers therein on opposite sides of the piston;

a first three way push pull valve having a fluid inlet port in communication with a source of pressurized fluid;

a fluid outlet port in communication with the first cylinder chamber;

a fluid pressure relief port; and valve means for connecting the outlet port to the inlet port while sealing the relief port when the first push pull valve is activated and for connecting the outlet port to the relief port while sealing the inlet port when the first push pull valve is deactivated;

a pilot vent valve connected by a transfer line to the relief port of the first push pull valve, the vent valve being adapted to exhaust fluid to atmosphere at an adjustable rate;

a three way pressure activated valve having a fluid inlet port in communication with a source of pressurized fluid;

a fluid outlet port in communication with the second cylinder chamber;

a vent port to atmosphere;

a pilot activated impulse chamber in fluid communication with the transfer line; and valve means for connecting the outlet port to the vent port while sealing the inlet port when the impulse chamber is at a pressure below a preselected threshold pressure, and for connecting the inlet port to the outlet port while sealing the vent port when the impulse chamber is at a pressure above the threshold pressure.

2. The invention of claim 1 wherein the first push pull valve is an electrically operated solenoid valve.

3. The invention of claim 2 wherein the first push pull valve further includes means for activating by a remote transmitter.

4. The invention of claim 1 wherein the pilot vent valve includes means for venting fluid to atmosphere at an adjustable rate; and means for admitting fluid from atmosphere into the fluid transfer line without impedance.

5. The invention of claim 4 wherein the cylinder is securely mounted to the frame.

6. The invention of claim 5 wherein the gate is a door.

7. The invention of claim 4 wherein the cylinder is mounted vertically and the gate is a window.

8. The invention of claim 4 wherein the apparatus is free of electrical components.

9. The invention of claim 4 wherein the outlet port of the pressure activated valve communicates to the second cylinder chamber through a second three way push pull valve comprising a fluid inlet port;

a fluid outlet port in fluid communication with the second cylinder chamber;

a fluid bypass port in fluid communication with the outlet port of the three way pressure activated valve; and valve means for connecting the outlet port to the inlet port while sealing the bypass port when the push pull valve is activated and for connecting the outlet port to the bypass port while sealing the inlet port when the push pull valve is deactivated; and wherein the apparatus further comprises a position sensing safety valve including a fluid inlet port in communication with a source of pressurized fluid;

a fluid outlet port in communication with the fluid inlet port of the second push pull valve; and valve means for connecting the inlet port and the outlet port in fluid communication only when the gate is in a locked position.

10. The invention of claim 9 further comprising an adjustable throttle valve intermediate the fluid outlet port of the safety valve and the inlet port of the second push pull valve.

11. The invention of claim 9 wherein the apparatus is free of electrical components.

12. The invention of claim 9 wherein the second push pull valve is an electrically operated solenoid valve.

13. The invention of claim 12 wherein the second push pull valve further includes means for activating by a remote transmitter.

14. The invention of claim 9 wherein the valve means of the pressure activated valve includes a spring.

15. A process for operating a sliding gate comprising the steps of:

(A) providing a sliding gate operating apparatus comprising:

a structure defining a framed opening for a gate;

a gate slidably mounted in the framed opening;

a fluid pressure activated cylinder having an axially disposed piston coupled to the gate so that the axial piston having a displacement which causes movement of the gate within the frame;

the cylinder defining first and second cylinder chambers therein on opposite sides of the piston;

a first three way push pull valve having a fluid inlet port in communication with a source of pressurized fluid;

a fluid outlet port in communication with the first cylinder chamber;

a fluid pressure relief port; and valve means for connecting the outlet port to the inlet port while sealing the relief port when the first push pull valve is activated and for connecting the outlet port to the relief port while sealing the inlet port when the first push pull valve is deactivated;

a vent valve connected by a transfer line to the relief port of the first push pull valve, the vent valve being adapted to exhaust fluid to atmosphere at an adjustable rate;

a three way pressure activated valve having a fluid inlet port in communication with a source of pressurized fluid;

a fluid outlet port in communication with the second cylinder chamber;

a vent port to atmosphere;

a pilot activated impulse chamber in fluid communication with the transfer line; and valve means for connecting the outlet port to the vent port while sealing the inlet port when the impulse chamber is at a pressure below a preselected threshold pressure, and for connecting the inlet port to the outlet port while sealing the vent port when the impulse chamber is at a pressure above the threshold pressure; and (B) activating the first push pull valve, thereby admitting pressurized fluid through the first push pull valve into the first cylinder chamber and venting compressing fluid in the second cylinder chamber to vent to atmosphere through the vent port of the pressure activated valve to cause the gate to slide in a first direction within the frame.

16. The invention of claim 15 further comprising the steps of:

(C) deactivating the first push pull valve, thereby venting the fluid through the first push pull valve and the pilot vent valve to atmosphere at a flow rate effective to maintain fluid in the impulse chamber of the pressure activated valve at a decreasing pressure above the preselected threshold pressure thereby causing pressurized fluid to enter the second cylinder chamber through the fluid outlet port of the pressure activated valve to slide the gate in a second direction opposite the first direction; and (D) lowering pressure of the fluid in the impulse chamber below the threshold pressure to cause the pressurized fluid in the second cylinder chamber to vent to atmosphere through the vent port of the pressure activated valve, thereby placing the gate in condition for either automatic or manual subsequent movement in the first direction.

17. The process of claim 15 further comprising the steps of:

(E) providing communication between the outlet port of the pressure activated valve and the second cylinder chamber through a second three way push pull valve including a fluid inlet port;

a fluid outlet port in fluid communication with the second cylinder chamber;

a fluid bypass port in fluid communication with the outlet port of the three way pressure activated valve; and valve means for connecting the outlet port to the inlet port while sealing the bypass port when the push pull valve is activated and for connecting the outlet port to the bypass port while sealing the inlet port when the push pull valve is deactivated; and (F) providing a position sensing safety valve including a fluid inlet port in communication with a source of pressurized fluid;

a fluid outlet port in communication with the fluid inlet port of the second push pull valve; and valve means for connecting the inlet port and the outlet port in fluid communication only when the gate is in a locked position;

(G) moving the gate to a locked position, thereby conducting pressurized fluid from the fluid inlet port to the fluid outlet port of the safety valve; and (H) activating the second push pull valve thereby causing pressurized fluid to flow from the fluid inlet port to the fluid outlet port thereof into the second cylinder chamber to lock the gate.

18. The invention of claim 15 wherein the first push pull valve is an electrically operated solenoid valve and is activated by a remote transmitter.

* * * * *